US009856054B2

(12) United States Patent
Seymour

(10) Patent No.: US 9,856,054 B2
(45) Date of Patent: Jan. 2, 2018

(54) CONTAINER HANDLING SYSTEM

(71) Applicant: Scott Allen Seymour, Tampa, FL (US)

(72) Inventor: Scott Allen Seymour, Tampa, FL (US)

( * ) Notice: Subject to any disclaimer, the term of this patent is extended or adjusted under 35 U.S.C. 154(b) by 0 days.

(21) Appl. No.: 15/342,839

(22) Filed: Nov. 3, 2016

(65) Prior Publication Data

US 2017/0050765 A1 Feb. 23, 2017

Related U.S. Application Data

(63) Continuation-in-part of application No. 14/632,045, filed on Feb. 26, 2015, now Pat. No. 9,517,860.

(51) Int. Cl.

| | |
|---|---|
| ***B65D 25/28*** | (2006.01) |
| ***B65D 25/32*** | (2006.01) |
| ***B44D 3/12*** | (2006.01) |
| ***B44D 3/14*** | (2006.01) |

(52) U.S. Cl.

CPC ..... *B65D 25/282* (2013.01); *B44D 3/12* (2013.01); *B44D 3/14* (2013.01); *B65D 25/32* (2013.01)

(58) Field of Classification Search

CPC . B44D 3/14; B44D 3/12; B65D 25/32; B65D 25/28; B65D 25/287; B65D 25/2873; B65D 25/282; B65D 25/2802; B25G 1/10; B25G 1/102

USPC ..... 220/760, 755, 752, 756, 754, 759, 758, 220/696, 699, 700, 701, 736; 16/425, 16/422, 430, 110.1; 248/318, 211, 210; D32/54, 53

See application file for complete search history.

(56) References Cited

U.S. PATENT DOCUMENTS

| | | | | |
|---|---|---|---|---|
| 5,203,471 A * | 4/1993 | Widman | ..... | A47G 23/0266 220/755 |
| D456,578 S * | 4/2002 | Smith | ..... | D32/54 |
| 8,863,981 B1 * | 10/2014 | Fontaine | ..... | B65D 25/22 220/755 |

* cited by examiner

*Primary Examiner* — Robert J Hicks
(74) *Attorney, Agent, or Firm* — Sandra L. Layer

(57) ABSTRACT

A container handling system that has an ergonomic handle which can be releasably coupled to the rim of a container such as a paint can, allowing the user to carry and manipulate the container with one hand. When the container handling system is coupled to the rim of a container, the upper portion of the handle provides a lifting surface for the index finger, thumb and hand of the user providing leverage and reducing hand fatigue.

6 Claims, 6 Drawing Sheets

FIG. 3
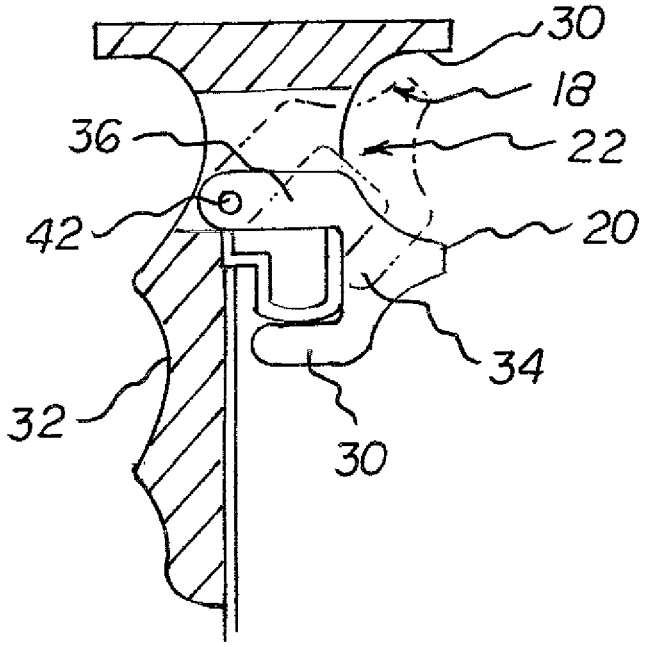
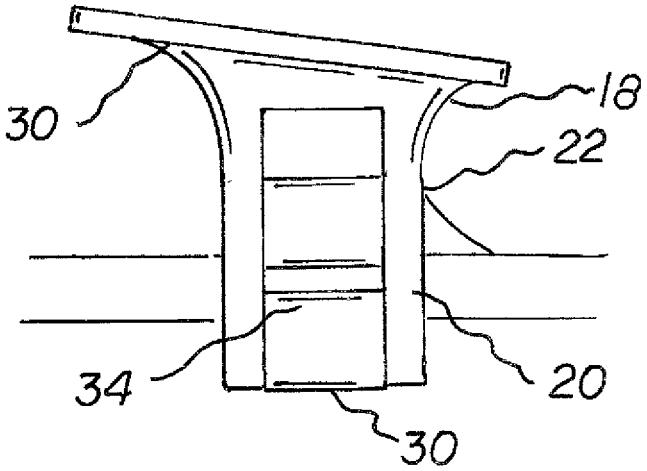
FIG. 4

CONTAINER HANDLING SYSTEM

RELATED APPLICATION

The present application is a continuation-in-part of pending U.S. patent application Ser. No. 14/632,045 filed Feb. 26, 2015, the subject matter of which application is incorporated herein by reference in its entirety.

BACKGROUND OF THE INVENTION

Field of the Invention

The present invention relates to a container handling system and more particularly pertains to an ergonomic handle for use with a container having a rim, such as a paint can.

Description of the Prior Art

The use of paint container handles is known in the prior art. Many painters prefer to paint directly from the can and are faced with the problem of holding the paint can with one hand in a manner such that the can is stable and easily manipulated without blocking access to the opening of the can while allowing the painter to the paint freely with their other hand. More specifically, container handles previously devised and utilized for the purpose of assisting the painter in holding the container are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe container handling system that allows an ergonomic handle for use with a container having a rim, such as a paint can.

In this respect, the container handling system according to the present invention substantially departs from the conventional concepts and designs of the prior art, and in doing so provides an apparatus primarily developed for the purpose of an ergonomic handle for use with a container having a rim.

Therefore, it can be appreciated that there exists a continuing need for a new and improved container handling system which can be used for an ergonomic handle for use with a container having a rim. In this regard, the present invention substantially fulfills this need.

SUMMARY OF THE INVENTION

In view of the foregoing disadvantages inherent in the known types of paint can handles now present in the prior art, the present invention provides an improved container handling system. As such, the general purpose of the present invention, which will be described subsequently in greater detail, is to provide a new and improved container handling system and method which has all the advantages of the prior art and none of the disadvantages. To attain this, for a broad perspective, the present invention essentially comprises a handling assembly for use with a container having a bottom and a top and a side wall with an interior and an exterior and a rim with an upper region and a lower region and an inner region and an outer region.

The handling assembly is formed in a generally mushroom shaped configuration with a gripping component above, and a coupling component below and an intermediate component between the gripping component and the coupling component.

When coupled to a container, the coupling component has an exterior portion in contact with the exterior of the container and an interior portion adjacent to the interior of the container. The interior portion is formed in a generally C-shaped configuration with an upper finger that rests on the upper portion of the rim, a middle finger adjacent to the interior edge of the rim and a lower finger under the lower edge of the rim.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved container handling system which has all of the advantages of the prior art paint can handles and none of the disadvantages.

It is another object of the present invention to provide a new and improved container handling system which may be easily and efficiently manufactured and marketed.

It is further object of the present invention to provide a new and improved container handling system which is of durable and reliable constructions.

An even further object of the present invention is to provide a new and improved container handling system which is susceptible of a low cost of manufacture with regard to both materials and labor, and which accordingly is then susceptible of low prices of sale to the consuming public, thereby making such container handling system economically available to the buying public.

Another object of the present invention is to provide a container handling system that allows for single handed support and manipulation of the container when painting, keeping the second hand free to paint.

Even still another object of the present invention is to provide a container handling system having an ergonomic handle for use with a paint can.

Still another object of the present invention is to provide a container handling system that alleviates wrist and hand fatigue.

Still another object of the present invention is to provide a system that is easily transferable from one paint can to another.

Another object of the present invention is to leverage upper rim of the container to provide stability and support and aiding in the manipulation of the container.

Lastly, it is an object of the present invention to provide a new and improved container handling system that does not block the container opening.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-section view of a container handling system taken along line 3-3 of FIG. 1.

FIG. 4 is an isometric view of a container handling system taken from the interior of the container.

The same reference numerals refer to the same parts throughout the various Figures.

DESCRIPTION OF THE PREFERRED EMBODIMENT

Figure 1:
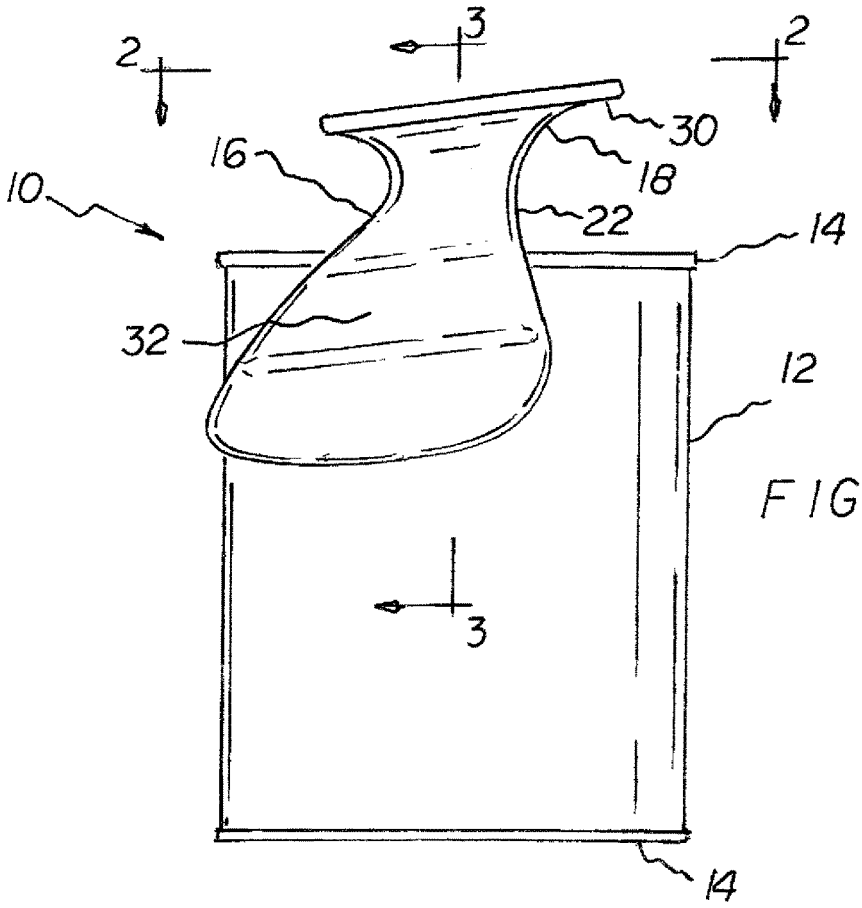
FIG. 1 is a perspective view of a container handling system constructed in accordance with the principles of the present invention coupled to a paint can.
Figure 2:
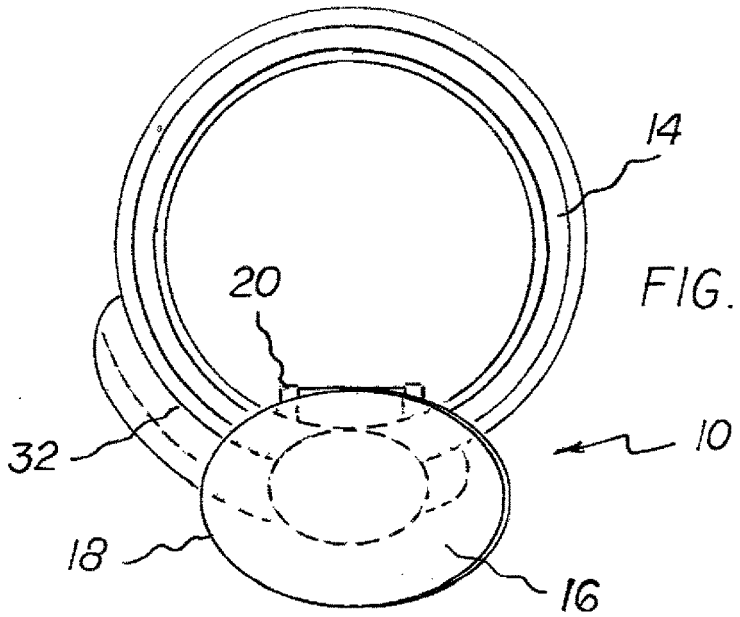
FIG. 2 is a top view of a container handling system taken along lines 2-2 of FIG. 1.

With reference now to the drawings, and in particular to FIGS. 1-4 thereof, the preferred embodiment of the new and improved container handling system embodying the principles and concepts of the present invention and generally designated by the reference numeral 10 will be described.

The present invention, the container handling system 10 is comprised of a plurality of components. Such components in their broadest context include an upper gripping component, an intermediate component, and a lower coupling component. Such components are individually configured and correlated with respect to each other so as to attain the desired objective.

From a specific perspective, the invention of the present application is a handling assembly for use with a container having a bottom and a top and a side wall with an interior and an exterior, the container having a rim with an upper region and a lower region and an inner region and an outer region. A handling assembly is in a generally mushroom shaped configuration having a gripping component above and a coupling component below and an intermediate component there between. The coupling component has an exterior portion in contact with the exterior of the container. The coupling component has an interior portion adjacent to the interior of the container. The interior portion is in a generally C-shaped configuration with an upper finger adjacent to the upper region of the rim. The interior portion has a lower finger adjacent to the lower region of the rim. The interior portion has a middle finger adjacent to the inner region of the rim. Such components are individually configured and correlated with respect to each other so as to attain the desired objective.

In the preferred embodiment of the container handling system, designated by reference numeral 10, first provided is a container handling system 10 for releasably coupling to a container having a rim and for holding in one hand by a painter. The coupling and the holding are done in a safe, convenient, and economical manner, the system includes the container 12 having a closed bottom and an open top and a side wall in a cylindrical configuration there between. The side wall has an interior and an exterior. The container has a rim 14 in an annular configuration. The rim has a generally rectangular cross sectional configuration with an upper region and a lower region and an inner region and an outer region. The outer region is coupled to the interior of the paint can adjacent to the open top.

A handling assembly 16 is in a generally mushroom shaped configuration. The handling assembly has a gripping component 18 above with a gripping circumference. The handling assembly has a coupling component 20 below with a coupling circumference. The handling assembly has an intermediate component 22 there between with an intermediate circumference. The intermediate circumference is smaller than the gripping circumference and the coupling circumference.

The intermediate component adapted to receive a fore finger and a thumb of a painter while holding the container.

The gripping component has a downwardly facing surface 30 adapted to be supported by the fore finger and thumb of the painter while holding the container.

The coupling component shown in FIGS. 3-4 has an exterior portion 32 in contact with the exterior of the container. The coupling component has an interior portion 34 adjacent to the interior of the container. The interior portion is in a generally C-shaped configuration with an upper finger 36 adjacent to the upper region of the rim. The interior portion has a lower finger 38 adjacent to the lower region of the rim. The interior portion has a middle finger 40 adjacent to the inner region of the rim. A pivot pin 42 is rotatable about a horizontal axis extending through the upper finger adjacent to the container. The interior portion of the coupling component is movable between a locking orientation and a releasing orientation. The locking orientation is with the interior portion of the coupling component lowered and in contact with the rim. The releasing orientation is with the interior portion of the coupling component raised and out of contact with the rim.

Figure 5:
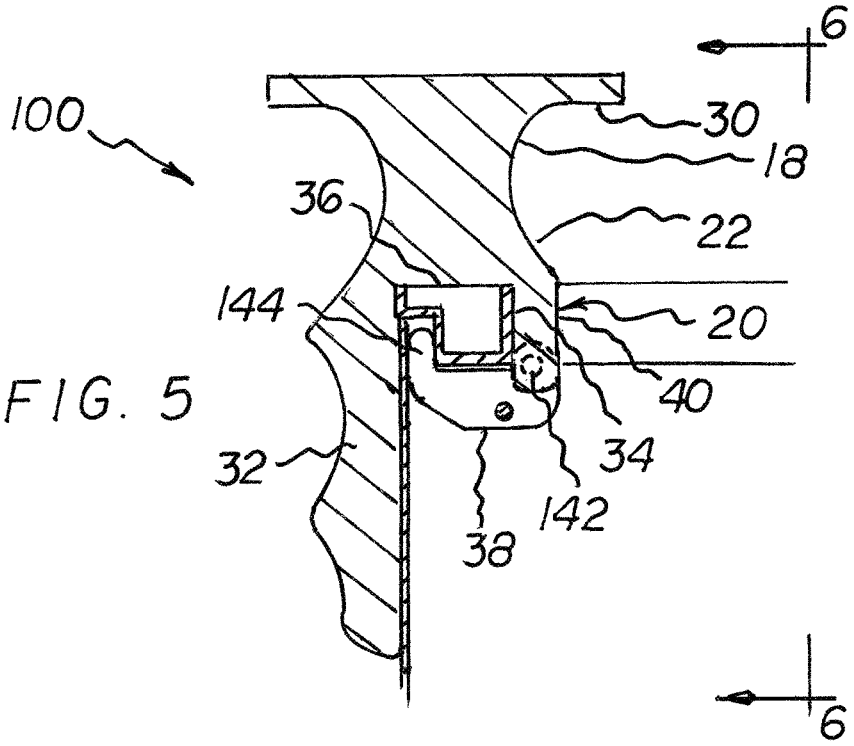
FIG. 5 is a cross-sectional side view of a container handling system constructed in accordance with the principles of an alternate embodiment of the present invention coupled to a paint can.
Figure 6:
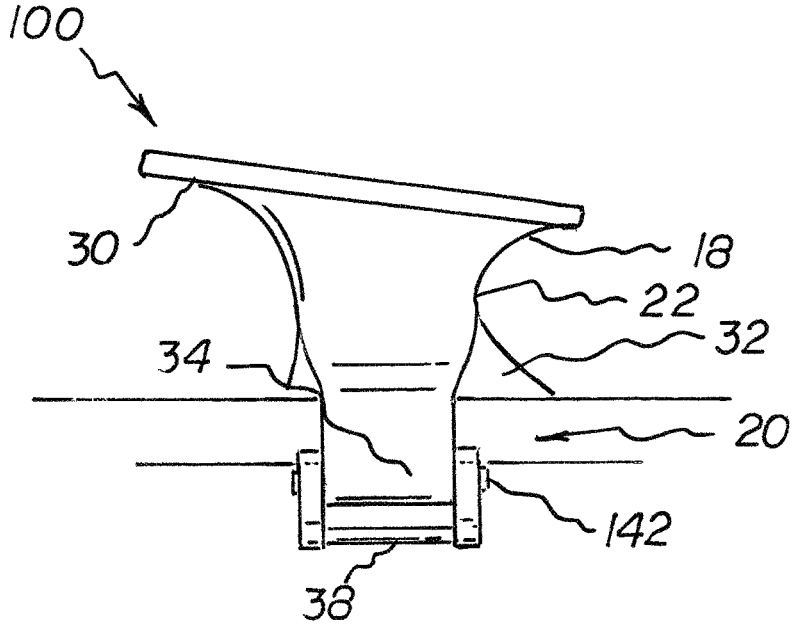
FIG. 6 is isometric view of a container handling system taken along lines 6-6 of FIG. 5.
Figure 7:
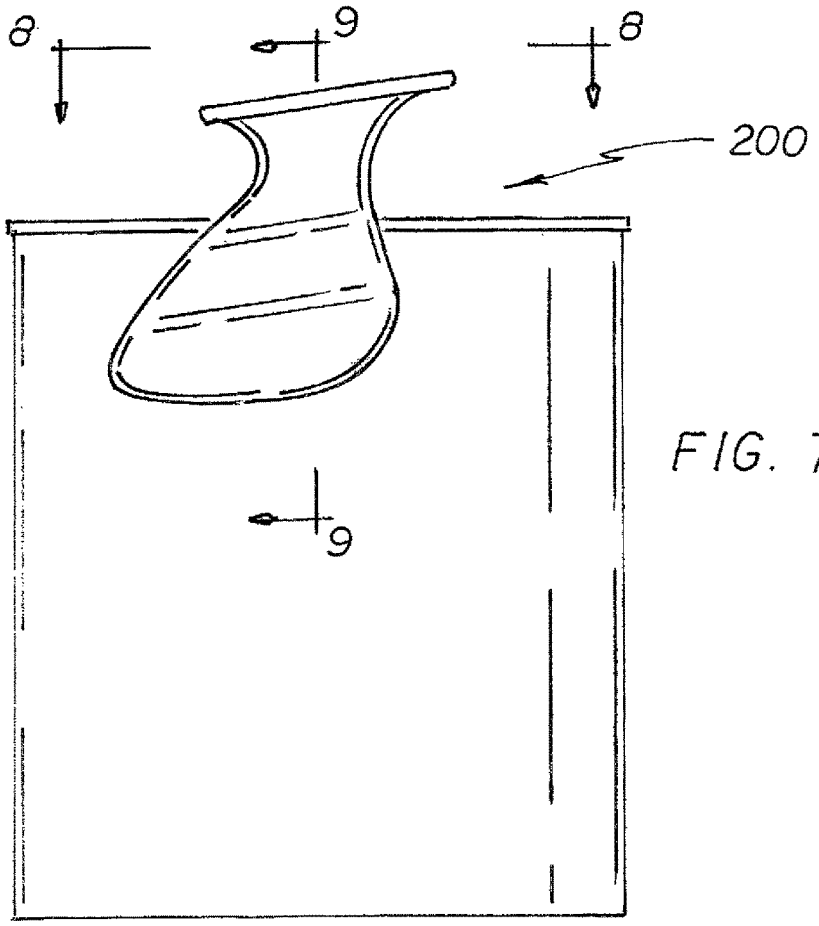
FIG. 7 is a perspective view of an alternate embodiment of a container handling system coupled to a paint can.
Figure 8:
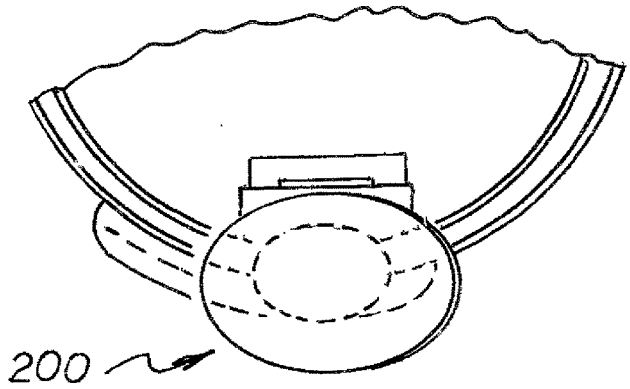
FIG. 8 is a top view of a container handling system taken along lines 8-8 of FIG. 7.
Figure 9:
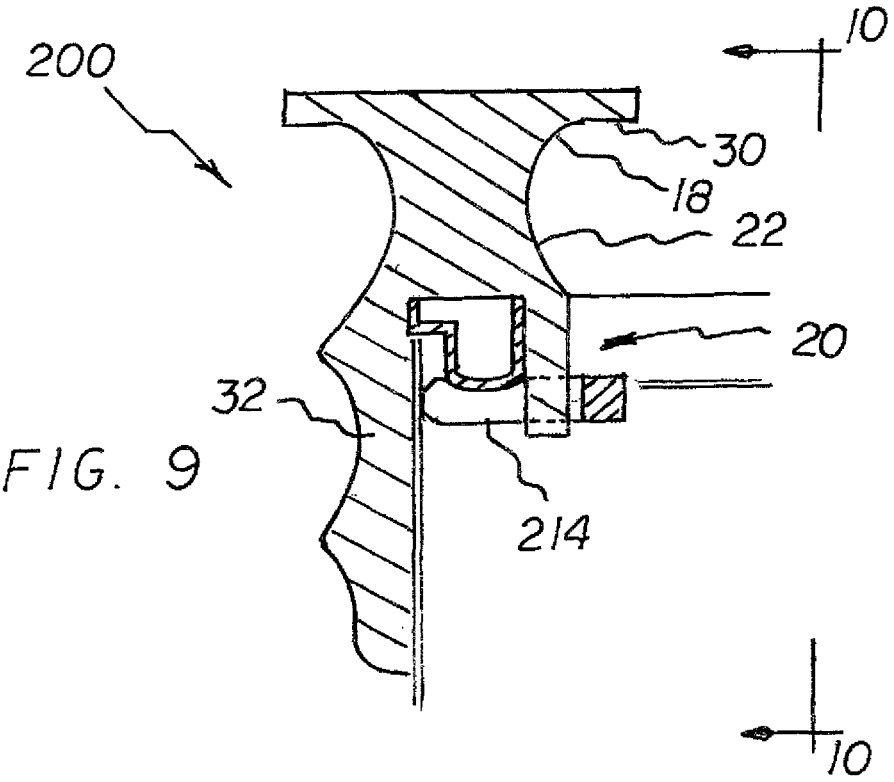
FIG. 9 is a cross-sectional view of an alternate embodiment of a container handling system taken along lines 9-9 of FIG. 7.
Figure 10:
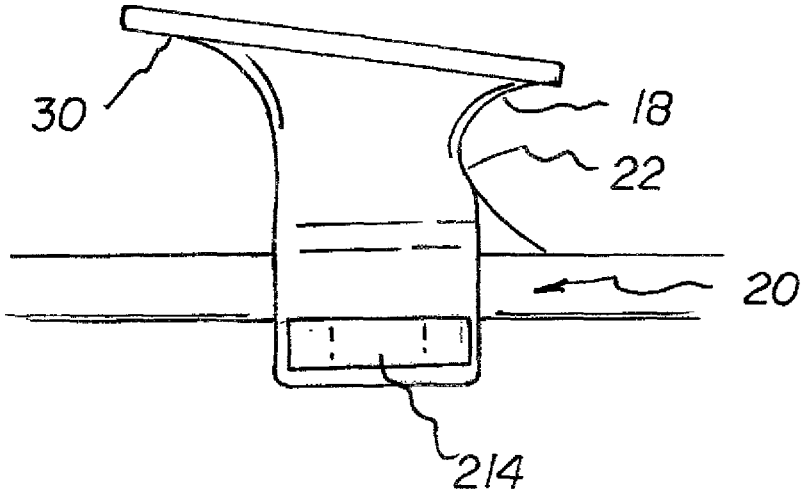
FIG. 10 is an isometric view of an alternate embodiment of container handling system taken along lines 10-10 of FIG. 9.

In the embodiment shown in FIGS. 5-6, the handling assembly 100 also includes a pivot pin 142 rotatable about a horizontal axis extending through the middle finger 40 adjacent to the lower finger 38. The handling assembly further includes a terminal finger 144 adjacent to the interior surface of the rim.

In the embodiment shown in FIGS. 7-10, the handling assembly 200 includes a lower finger 214 axially shiftable between an extended operative orientation and a retracted inoperative orientation.

Figure 11:
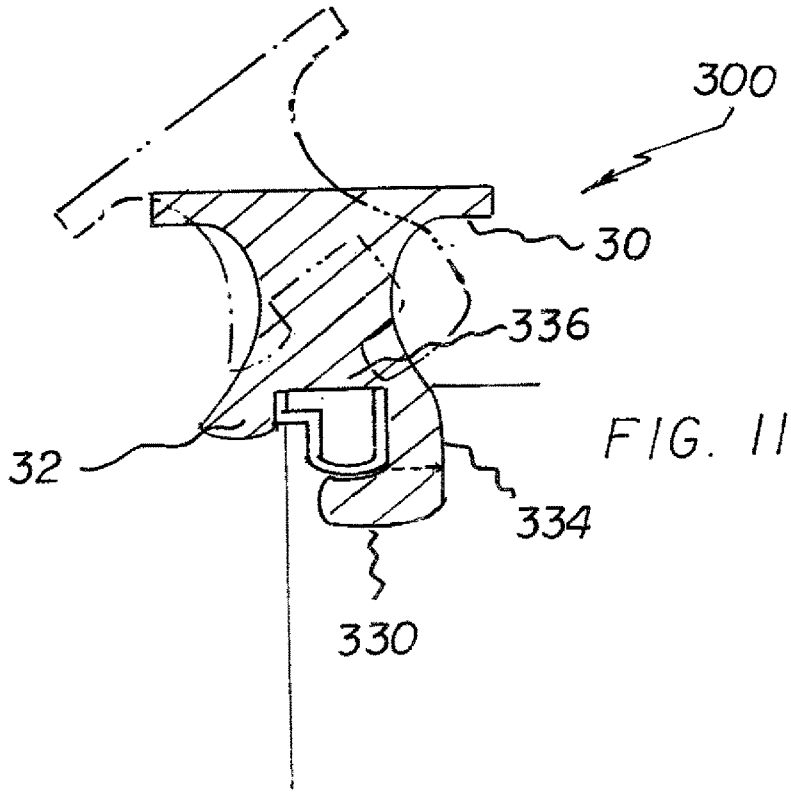
FIG. 11 is a cross-section view of an alternate embodiment of a container handling system.
Figure 12:
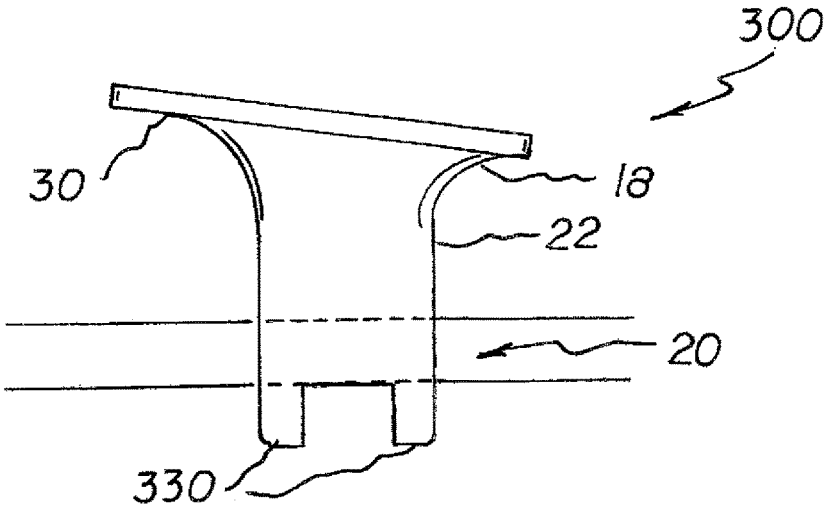
FIG. 12 is an isometric view of an alternate embodiment of container handling system taken from inside the paint can.

In the embodiment shown in FIGS. 11-12, the handling assembly 300 features the upper finger 336 and the lower finger 330 and the middle finger 334 all integrally fabricated together.

Painters are often faced with the dilemma of how to hold a paint can or bucket with one hand while painting with the other hand in order to work as quickly and efficiently as possible. Many painters attempt to hold the can at the point where the wire handle attaches to the can, placing wire between their thumb and index finger allowing the weight to rest on the top of the thumb and using their fingers to hold the can steady. This configuration often leads to pain and fatigue and the wire 'bites' into the thumb of the painter. The ergonomic design of the container handling system will allow painters to hold and manipulate a paint can or bucket while painting. When coupled to a paint can or bucket the amount of strain placed on the wrist when holding and manipulating the can is lessened and the handle causes minimal blockage of the access to the opening. Proper use of the device reduces the amount of torque on the wrist by positioning the center point of the wrist (the fulcrum) to the closest point to the center of gravity of the container being held. The underside of the upper portion rests on the top of the fore finger, thumb and area in between providing a lifting surface. This provides the largest amount of coverage of the possible weight bearing area of the hand in its natural position as well as adding more area of friction for lift on the fingers. Proper positioning coupled with the pulling up action from the fingers causes the torque to be spread both above and below of the fulcrum point of the wrist.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A handling assembly for use with a can having a bottom and a top and a side wall with an interior and an exterior, the can having a rim with an upper region and a lower region and an inner region and an outer region, the outer region being coupled to the interior of the paint can;

the handling assembly in a mushroom shaped having a gripping component above with a gripping circumference, the handling assembly having a coupling component below with a coupling circumference, the handling assembly having an intermediate component there between with an intermediate circumference, the intermediate circumference being smaller than the gripping circumference and the coupling circumference, the gripping component, coupling component and intermediate component vertically aligned and formed as a compact unitary structure;

the coupling component having an exterior portion in contact with the exterior of the can, the coupling component having an interior portion in contact with the interior of the can, the interior portion being in a rectangular C-shaped configuration with an upper finger in contact with the upper region of the rim, the interior portion having a lower finger in contact with the lower region of the rim, the interior portion having a middle finger in contact with the inner region of the rim.

2. The handling assembly as set forth in claim 1 and further including a pivot pin rotatable about a horizontal axis extending through the middle finger adjacent to the lower finger, the handling assembly further including a terminal finger in contact with the surface of the rim between the lower region of the rim and the can.

3. The handling assembly as set forth in claim 1 wherein the lower finger is axially shiftable between an extended operative orientation and a retracted inoperative orientation.

4. The handling assembly as set forth in claim 1 and further including a pivot pin rotatable about a horizontal axis extending through the upper finger remote from the middle finger.

5. The handling assembly as set forth in claim 1 wherein the upper finger and the lower finger and the middle finger are all integrally fabricated together.

6. A paint can handling system for releasably coupling to a paint can and for holding in one hand by a painter, the system comprising, in combination:

the paint can having a closed bottom and an open top and a side wall in a cylindrical configuration there between, the side wall having an interior and an exterior;

a rim in an annular configuration, the rim having a rectangular cross sectional configuration with an upper region and a lower region and an inner region and an outer region, the outer region being coupled to the interior of the paint can adjacent to the open top;

a handling assembly in a mushroom shaped configuration, the handling assembly having a gripping component above with a gripping circumference, the handling assembly having a coupling component below with a coupling circumference, the handling assembly having an intermediate component there between with an intermediate circumference, the intermediate circumference being smaller than the gripping circumference and the coupling circumference;

the intermediate component adapted to receive a fore finger and a thumb of a painter while holding the paint can;

the gripping component having a downwardly facing surface adapted to be supported by the fore finger and thumb of the painter while holding the paint can;

the coupling component having an exterior portion in contact with the exterior of the paint can, the coupling component having an interior portion in contact with the interior of the paint can, the interior portion being in a rectangular C-shaped configuration with an upper finger adjacent to the upper region of the rim, the interior portion having a lower finger in contact with the lower region of the rim, the interior portion having a middle finger in contact with the inner region of the rim, a pivot pin rotatable about a horizontal axis extending through the upper finger adjacent to the paint can, the interior portion of the coupling component being movable between a locking orientation and a releasing orientation, the locking orientation being with the interior portion of the coupling component lowered and in contact with the rim, the releasing orientation being with the interior portion of the coupling component raised and out of contact with the rim.

* * * * *